US009782615B2

(12) United States Patent
Stepancic

(10) Patent No.: US 9,782,615 B2
(45) Date of Patent: Oct. 10, 2017

(54) FIRE FIGHTING WATER ADDITIVE

(71) Applicant: Biocentral Laboratories Limited, Thebarton (AU)

(72) Inventor: John Paul Stepancic, Dernancourt (AU)

(73) Assignee: Biocentral Laboratories Limited, Thebarton (AU)

( * ) Notice: Subject to any disclaimer, the term of this patent is extended or adjusted under 35 U.S.C. 154(b) by 454 days.

(21) Appl. No.: 14/322,296

(22) Filed: Jul. 2, 2014

(65) Prior Publication Data

US 2015/0014571 A1 Jan. 15, 2015

(30) Foreign Application Priority Data

Jul. 5, 2013 (AU) ..... 2013206711

(51) Int. Cl.
*A62D 1/00* (2006.01)

(52) U.S. Cl.
CPC ..... *A62D 1/0042* (2013.01); *A62D 1/0035* (2013.01)

(58) Field of Classification Search
CPC ..... A62D 1/0042; A62D 1/0035
USPC ..... 252/8.05, 8
See application file for complete search history.

(56) References Cited

U.S. PATENT DOCUMENTS

| | | | | | |
|---|---|---|---|---|---|
| 3,404,089 | A * | 10/1968 | Holzinger | A62D 1/0042 | 252/2 |
| 5,989,446 | A * | 11/1999 | Hicks | A62D 1/0042 | 106/18.11 |
| 2007/0289752 | A1* | 12/2007 | Beck | A62D 1/0035 | 169/47 |
| 2010/0063180 | A1* | 3/2010 | Kang | A62D 1/0064 | 523/337 |

* cited by examiner

*Primary Examiner* — David Karst
(74) *Attorney, Agent, or Firm* — The Webb Law Firm

(57) ABSTRACT

A polymeric fire fighting water additive composition containing an aqueous emulsion of acrylic copolymer, and an emulsifier. The acrylic copolymer is preferably polyacrylamide. The acrylic copolymer has a polymeric weight of 5,000,000-50,000,000 Daltons or between 12,000,000-15,000,000 Daltons and is negatively charged. A surfactant acts as an inverter. The aqueous emulsion of acrylic copolymer is present in a range 35% to 70% by volume in the concentrate and the emulsifier is present in a range 10% to 70% by volume.

16 Claims, No Drawings

FIRE FIGHTING WATER ADDITIVE

CROSS-REFERENCE TO RELATED APPLICATION

This application claims priority to Australian Patent Application No. 2013206711 filed Jul. 5, 2013, the disclosure of which is hereby incorporated in its entirety by reference.

FIELD OF THE INVENTION

The prescribed invention relates to a polymeric fire fighting water additive composition. The invention also relates to the method of manufacture of such a composition and to the formulation of the composition into a low usage rate product that can be applied in modern and specifically designed induction and displacement systems.

BACKGROUND OF THE INVENTION

Water alone is, in many instances, a suitable fire suppressant for fires and is useful in many fire fighting situations. For example water, being readily available, is frequently the preferred choice of fire extinguishing material, particularly in extinguishing wildfires.

The ability of water to douse a fire is enhanced by the addition of fire retardants. The current the fire retardants for many bushfires/wild land fires throughout the world are phosphate retardants and foams mixed with water in a range of dosage mixture ratios.

Such products increase the extinguishing effect of water. However, the use of phosphate based retardants and foams are problematic for government authorities in that they have a detrimental ecological effect. Thus there is a global demand for environmentally friendly, non-toxic fire suppressants that perform as well as, or better than existing products.

As well as in wildfire situations water is used as a fire fighting medium in confined locations, for example in houses, planes and on boats. Boats and planes often have a water tank in which a water supply is connected to a distribution apparatus to ensure that, in the event of a fire a sprinkler system comes into operation to douse the fire. Because of the limited volume of water that is available for fire fighting in such environments it is important that the water is used as effectively as possible.

In other situations water is not suitable for use in fighting fires and other fire fighting materials are used. For example in electrical fires the use of water is generally regarded as very dangerous and is not recommended. In such fires a dry powder retardant may be recommended for use.

Unfortunately, a consequence of the use of both water and dry powder fire retardants in confined spaces can be a great deal of damage. Dry powder retardants typically work by smothering a fire thereby depriving the fire of oxygen. To achieve this a spray of very fine powder is spread over the area in question covering generally, not only the area in which the fire occurs but all around the fire area as well. This is difficult, time consuming and costly to clear away.

Accordingly, there is a need to find a fire retardant medium that is efficient whilst causing a minimum damage to the area in which the retardant in used.

SUMMARY OF THE INVENTION

In one form the invention resides in a polymeric fire fighting water additive composition containing an aqueous emulsion of acrylic copolymer, and an emulsifier.

Preferably the acrylic copolymer is a polyacrylamide. More preferably, still the copolymer has a polymeric weight of 5,000,000-50,000,000 Daltons. More preferably, the acrylic copolymer has a polymeric weight of 12,000,000-15,000,000 Daltons and negatively charged.

In one embodiment of the invention, the composition additionally includes a surfactant which acts as an inverter.

The composition of the invention is adapted for incorporation into potable, hard or salty water and thus, is adapted for use in fighting bushfires/wild land fires from the air and on the ground.

Alternatively, after significant dilution with water, the retardant of the invention can be incorporated into ultra fine (fog) misting equipment and can be used in enclosed spaces, such as for example tunnels, boats and planes. Ultra fine (fog) misting equipment such as hand held extinguishers and sprinkler systems with nozzle technology, which is capable of producing a mist of water droplets of less than 80 microns diameter. Such a spray has a number of effects when used in fire fighting. Firstly, the production of a very fine mist (fog) of water optimises the ability of the water to cool and extinguish a fire. Thus, the quantity of water used to fight a fire is greatly reduced and the ability of the limited volume of water available on planes and boats to fight a fire is substantially extended. Secondly, the mist produced by such equipment is very fine and barely feels wet and created very little, if any, damage to the surrounding components of the environment.

The incorporation of the composition of the invention into a water supply used in ultra fine sprinklers/extinguishers of this type enhances the performance and efficiency of the sprinklers/extinguisher.

In further forms of the invention water present in the formulation is replaced with a suitable antifreeze material. Thus, if the composition of the invention is to be stored in any location where temperature below freezing are likely to be encountered the composition will be less affected.

The copolymers used in the composition of the invention are known and have previously found application in food processing, water treatment and paper industries and these materials are characteristically safe around humans, animals and all plant life. It has been found that, advantageously, the composition of the invention also acts to reduce the natural corrosive effects of salt water, whilst at the same time being corrosion neutral in fresh water.

Preferably the aqueous emulsion of acrylic copolymer is present in a range 35% to 70% by volume in the concentrate. The emulsifier is present in a range 10% to 70% by volume, and the surfactant/inverter may be present in a range 0.01% to 10% by volume.

The composition is a concentrate and, for practical purposes it may be necessary to use a filler, such as water, to increase to final volume of the concentrate to facilitate easier mixing of the concentrate into a batch of water. It will be appreciated that it is difficult to ensure thorough mixing when incorporating a very small volume of concentrate into a larger volume of water.

The filler discussed above may be present in a range of up to 40% and the filler may be selected to act as a suspension assister for the polymeric fire fighting water additive concentrate.

When fighting fires from the air, known generally as water bombing, the load to be carried by the aircraft is a significant factor. The composition of the invention is used in concentrated form and has thus been found to be effective in reducing the amount of additive material required to be carried on board an aircraft. The fire fighting authorities also require an additive that mixes readily with water, either potable or salt, to simplify the process for the pilots/operators. Moreover with water, this invention has the distinct advantage of being added whilst refilling, even at remote water locations for fixed wing aircraft that scoop water from the sea or lakes and helicopters that hover to refill. This results in increased missions and has the potential to reduce flying time between missions.

Water bombing operations currently use phosphate retardants that can be restrictive due to a large amount of the chemical, up to 10%, required in the mix, Further complication is experienced because of the requirement for land based mixing plants adjacent to aircraft landing facilities. As an example, aircraft with a water load capacity of say 10,000 liters requires up to 1,000 kilograms of retardant.

The polymeric fire fighting water additive composition of the invention, by contrast, may be used in a ratio of 0.2:1000 by volume with water to 1:1000 by volume with water, typically a ratio of 2 L concentrate per 1000 L of water will be used.

The polymeric fire fighting water additive concentrate may further include a small amount of dye. The purpose of the dye is to colour the final concentrate to enable recognition of the product type.

The aqueous emulsion of acrylic copolymer is preferably anionic and negatively charged. The emulsifier is also preferably aliphatic cycloparatltnic hydrocarbons. The surfactant/inverter is preferably isotridecanolethoxylate. In a preferred invention formulation, the filler and suspension as sister may be a 0.1-10% solution of water.

In a further formulation description therefore, the invention is said to reside in a polymeric fire fighting water additive concentrate having 40 to 60% aqueous emulsion of acrylic copolymer, 30 to 60% of an emulsifier and 0.01 to 5% of a surfactant/inverter.

More preferably the invention is said to reside in a polymeric fire fighting water additive concentrate with a pH of approximately 7.1 with approximately 50% anionic aqueous emulsion of acrylic copolymer, 49% aliphatic cycloparaffinic hydrocarbon and 0.5% isotridecanolethoxylate filler and suspension assister. All of the above concentrations are by volume. The concentrate may further include a dye of suitable colour.

In accordance with a further aspect of the invention there is provided a method of manufacturing a fire retardant additive composition, said method comprising the steps of:

1. Adding an emulsifier to an aqueous emulsion of acrylic copolymers with stirring to form a premix; and
2. Optionally adding a surfactant/inverter with mixing to the premix to form a composition and allowing the premix to stand; and
3. Adjusting the pH of the composition to within a pre-determined range, preferably close to neutral.

DESCRIPTION OF THE PREFERRED EMBODIMENT

The above description essentially outlines the invention, but to further assist with a level of understanding, reference follows to a particular example and a method of mixing the concentrate that has been found to be efficacious.

It should be noted that the resultant product is for all intents and purposes the formulation, which performs and acts as described above.

Example 1—Wildfire Fighting Composition

The following ingredients are prepared in quantity:

Anionic aqueous emulsion of acrylic copolymer: 25 L
Aliphatic cycloparaffinic hydrocarbon: 24 L
Ilsotridecanolethoxylate: 50 ml.
Water (optional as suspension assister) 1 L
Polymer Dye (colour to suit) Optional 5 ml.

The ingredients are combined in the following order:

1. The aqueous emulsion of acrylic copolymers must be placed in mixing vat and mixed for approximately 10 minutes.
2. Whilst mixer is still in progress add Aliphatic Cycloparaffinic Hydrocarbon and mix for approximately 45 minutes.
3. Whilst mixer is in progress add isotridecanolethoxylate slowly and mix for approximately 15 minutes and let sit for minimum 1 hour.
4. If suspension assister is required for warmer climates (optional) whilst mixer is still in progress, add water very slowly and mix for approximately 30 minutes.

and let sit for a minimum 6 hours then mix again for 30 minutes prior to packaging through a filter system (approx 300 microns).

If the ingredients in this formula are not mixed in the above order, [critically No. 1 & 2 prior to No. 3] & [Nos. 1, 2 & 3 prior to No. 4] the finished product will be unusable as planned for in this invention. The water must be added slowly to the polymer mixture, you cannot add the polymer mixture to water in these quantities.

The mixer should be a vat type with propeller type mixing equipment.

By this formulation and manufacture means, a polymeric fire fighting water additive concentrate is formed which can be packed in plastic drums, plastic dispenser bags with one way valves, or similar containers.

As described above the concentrate can be used in a ratio of 2:1000 liters of water alternatively the concentrate may be used in concentrations of 0.5:1000 to 4:1000 depending on the specific application requirement.

Example 2—Wildfire Fighting Composition

Anionic aqueous emulsion of acrylic copolymer: 25 L
Aliphatic cycloparaffinic hydrocarbon: 23 L
Isotridecanolethoxylate: 50 ml.
Polypropylene Gylcol: 1 L
Water 1 L 1. The aqueous emulsion of acrylic copolymers must be placed in mixing vat and mixed for approximately 10 minutes.
2. Whilst mixer is still in progress add Aliphatic Cycloparaffinic Hydrocarbon and mix for approximately 45 minutes.
3. Whilst mixer is in progress add isotridecanolethoxylate slowly and mix for approximately 15 minutes and let sit for minimum 1 hour.
4. Premix glycol with the required amount of water.
5. Whilst mixer is still in progress, add water/glycol premix very slowly and mix for approximately 30 minutes and let sit for a minimum 6 hours then mix again for 30 minutes prior to packaging through a filter system (approx 300 microns).

As with example 1 given above it is important that the mixing regimes is as followed above.

As with the examples given it is found that the invention can be frozen and thawed back to its pre-frozen state which is uncommon for normal polyacrylamide emulsions.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

In any claims that follow and in the summary of the invention, except where the context requires otherwise due to express language or necessary implication, the word "comprising" is used in the sense of "including", i.e. the features specified may be associated with further features in various embodiments of the invention.

The invention claimed is:

1. A polymeric fire fighting water additive composition comprising an aqueous emulsion of acrylic copolymer, and an emulsifier, wherein the emulsifier is an aliphatic cycloparaffinic hydrocarbon.

2. A polymeric fire fighting water additive composition as in claim 1, wherein the acrylic copolymer is a polyacrylamide.

3. A polymeric fire fighting water additive composition as in claim 1, wherein the acrylic copolymer has a molecular weight of 5,000,000-50,000,000 Daltons.

4. A polymeric fire fighting water additive composition as in claim 1, wherein the acrylic copolymer has a molecular weight of 12,000,000-15,000,000 Daltons and is negatively charged.

5. A polymeric fire fighting water additive composition as in claim 1, further comprising a surfactant which acts as an inverter.

6. A polymeric fire fighting water additive composition as in claim 5, wherein the surfactant/inverter is present in a range 0.01% to 10% by volume.

7. A polymeric fire fighting water additive composition as in claim 5, wherein the surfactant/inverter is isotridecanolethoxylate.

8. A polymeric fire fighting water additive composition as in claim 1, wherein the aqueous emulsion of acrylic copolymer is present in a range 35% to 70% by volume in the composition, and the emulsifier is present in a range 10% to 70% by volume.

9. A polymeric fire fighting water additive composition as in claim 1, further comprising a filler for increasing to final volume of the composition to facilitate easier mixing of the composition into a batch of water.

10. A polymeric fire fighting water additive composition as in claim 9, wherein the filler is present up to 40% by volume.

11. A polymeric fire fighting water additive composition as in claim 9, wherein the filler is a 0.1-10% solution of water.

12. A polymeric fire fighting water additive composition as in claim 1, further comprising a dye.

13. A polymeric fire fighting water additive composition as in claim 1, wherein the composition is anionic and negatively charged.

14. A polymeric fire fighting water additive composition comprising 40% to 60% aqueous emulsion of acrylic copolymer, 30% to 60% of an emulsifier, and 0.01% to 5% of a surfactant/inverter, wherein the emulsifier is an aliphatic cycloparaffinic hydrocarbon.

15. A polymeric fire fighting water additive concentrate having a pH of approximately 7.1, comprising about 50% anionic aqueous emulsion of acrylic copolymer, 49% aliphatic cycloparaffinic hydrocarbon, and 0.5% isotridecanolethoxylate filler and suspension assister, all of the above concentrations by volume.

16. A polymeric fire fighting anti-freeze additive composition, comprising an aqueous emulsion of acrylic copolymer, and an emulsifier, wherein the emulsifier is an aliphatic cycloparaffinic hydrocarbon.

* * * * *